US007090326B2

(12) United States Patent
Hengesbach et al.

(10) Patent No.: US 7,090,326 B2
(45) Date of Patent: Aug. 15, 2006

(54) AUTOMATIC STARTUP SEQUENCE FOR THE SOLVENT INK PRINTING SYSTEM

(75) Inventors: Paul K. Hengesbach, Kettering, OH (US); John C. Loyd, Beavercreek, OH (US)

(73) Assignee: Eastman Kodak Company, Rochester, NY (US)

( * ) Notice: Subject to any disclaimer, the term of this patent is extended or adjusted under 35 U.S.C. 154(b) by 210 days.

(21) Appl. No.: 10/839,537

(22) Filed: May 5, 2004

(65) Prior Publication Data

US 2005/0248609 A1 Nov. 10, 2005

(51) Int. Cl.
*B41J 2/165* (2006.01)

(52) U.S. Cl. ..... 347/28

(58) Field of Classification Search ... 347/28; B41J 2/165

See application file for complete search history.

(56) References Cited

U.S. PATENT DOCUMENTS 4,286,272 A * 8/1981 Schwob ..... 347/74
4,600,928 A 7/1986 Braun et al.
6,145,954 A * 11/2000 Moore ..... 347/28
6,273,103 B1 * 8/2001 Enz et al. ..... 134/22.11
6,848,767 B1 * 2/2005 West et al. ..... 347/28
6,890,054 B1 * 5/2005 West ..... 347/28

* cited by examiner

*Primary Examiner*—K. Feggins
*Assistant Examiner*—Rene Garcia, Jr.
(74) *Attorney, Agent, or Firm*—BuskopLawGroup

(57) ABSTRACT

An automatic startup sequence for an ink jet print station using solvent based ink entails introducing a flushing fluid to the drop generator using the flushing fluid pump at a drive level and a flushing pressure that enables flushing fluid to flow through the jet array at a flow rate adequate to permit the catcher assembly to extract the flushing fluid; engaging the ink pump; and increasing the pressure of the flushing fluid from the initial pressure. The increased pressure is high enough for stable drop formation and drop deflection from the jet array and low enough to extract drops from the catcher, and to permit flushing fluid to flow freely through the catcher. The method ends by simultaneously opening the ink supply valve and closing the flushing fluid valve permitting ink to flow into the drop generator; and then stopping the flow of the flushing fluid.

7 Claims, 3 Drawing Sheets

AUTOMATIC STARTUP SEQUENCE FOR THE SOLVENT INK PRINTING SYSTEM

FIELD OF THE INVENTION

The present embodiments relate to an improved startup sequence for ink jet print stations when using low surface tension inks.

BACKGROUND OF THE INVENTION

Prior art ink jet printing systems have steady state problems of "spitting" ink from the catcher when used with low surface tension inks. "Spitting" results from a poor two phase flow mixture in the catcher that periodically causes ink to 'spit' out. Over time, the ink 'spit' from the catcher builds up on the eyelid of the catcher assembly. The buildup, in turn, interferes with the printing drops causing print defects that force the operator to manually clean the eyelid. The solution of decreasing the vacuum supply to the printhead inadequately addresses the "spitting" problem.

The present methods have been designed to solve the steady state problems of "spitting" ink from the catcher.

SUMMARY OF THE INVENTION

The embodied methods relate to an automatic startup sequence for an ink jet print station using solvent based ink. The print station includes an orifice structure connected to the drop generator forming a jet array, a catcher assembly disposed opposite the jet array with a charge device, and an eyelid for engaging a catcher. The print station includes a catcher return line, a flushing fluid line connected to the drop generator, a flushing fluid pump and a flushing fluid valve disposed in the flushing fluid line. An anti-wicking return line, an ink pump, and an ink supply valve are disposed in the ink supply line.

The method entails introducing a flushing fluid to the drop generator using the flushing fluid pump at a drive level and at an initial flushing pressure that enables flushing fluid to flow through the jet array at a flow rate adequate to permit the catcher assembly to extract the flushing fluid. An operating voltage is applied to the charge device, and the ink pump is engaged using a drive level equivalent to the drive level of the flushing fluid pump to pressurize the ink supply line. The method continues by increasing the pressure of the flushing fluid from the initial flushing pressure while passing the flushing fluid through the jet array to an increased pressure. The increased pressure is between a pressure for stable drop formation and drop deflection from the jet array and at a second pressure sufficiently low enough to extract drops from the catcher assembly and to permit flushing fluid to flow freely through the catcher assembly and the anti-wicking return line. The method ends by simultaneously opening the ink supply valve and closing the flushing fluid valve permitting ink to flow into the drop generator. The flow of the flushing fluid is stopped concurrently with increasing pressure of the ink supply line to a stored operating value.

BRIEF DESCRIPTION OF THE DRAWINGS

In the detailed description of the preferred embodiments presented below, reference is made to the accompanying drawings, in which.

The present embodiments are detailed below with reference to the listed Figures.

DETAILED DESCRIPTION OF THE INVENTION

Before explaining the present embodiments in detail, it is to be understood that the embodiments are not limited to the particular descriptions and that it can be practiced or carried out in various ways.

These embodied methods are techniques for ink jet printer startup sequences where the print station uses solvent based inks.

The methods enable the use of a smaller catcher return line and a separate anti-wicking line, while still handling larger system fluid flow rates by carefully controlling the timing and amount of pressurization of the various fluid lines to the drop generator during start up.

The embodied methods successfully prevent ink from splattering during the transition from using flushing fluid to ink use during the ink jet print station start up. Specifically, the method keeps the eyelid of the catcher assembly clean during start up processes.

By preventing splatter during this transition, the charge device is kept clean during start up ensuring reliable operation The method stops spitting from the catcher assembly that causes print defects.

The methods provide an environmental advantage by reducing the presence of volatile fumes by reducing the amount of vacuum needed to return ink to the reservoir for ink.

Figure 1:
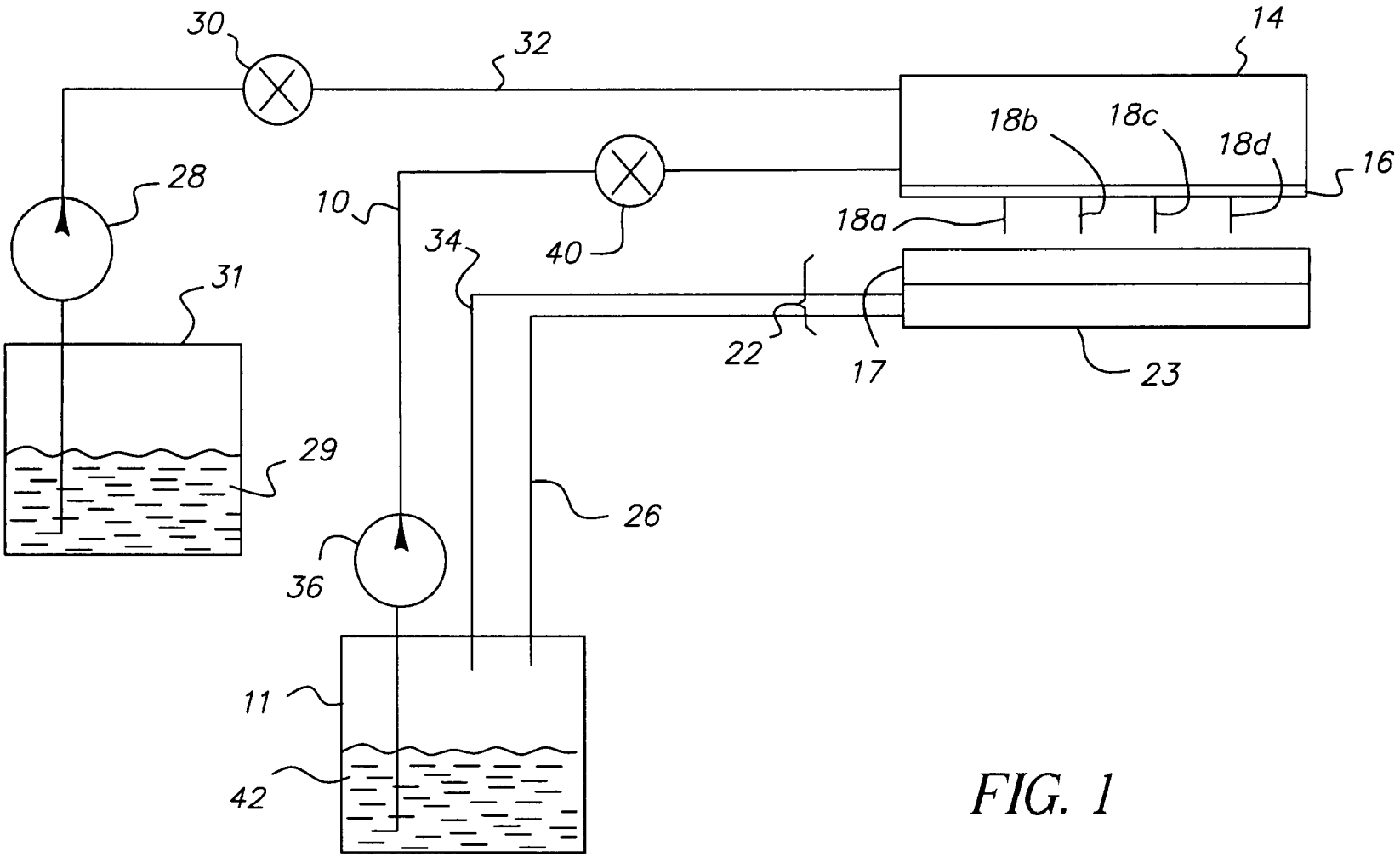
FIG. 1 depicts a schematic of the equipment used in an embodied method.

With reference to the figures, FIG. 1 depicts the equipment of the improved print station that is used in the automatic startup.

The print station has an ink supply line 10 that is pressurized with ink from a reservoir 11 with ink 42 or another supply source. The ink supply line 10 is pressurized using an ink pump 36. An ink supply valve 40 is connected to the ink supply line 10 to control flow of ink from the reservoir for ink 11 to a drop generator 14. An example of an ink jet print station is a Kodak Versamark DT92 print station available from Kodak Versamark of Dayton, Ohio. The drop generator 14 has an orifice structure 16 with a plurality of orifices to form a jet array with jets 18*a*, 18*b*, 18*c* and 18*d*. Orifice structures with 256 orifices from 256 jets are typically used in an exemplary ink jet print station according to one of the embodied methods. Other exemplary print stations have 120 jets per inch or 240 jets per inch.

Examples of solvent-based inks that can be used with the embodied ink jet print stations include Black Solvent Ink Model Number 7101, available from Kodak Versamark of Dayton, Ohio.

A catcher assembly 22 is disposed opposite the jet array. The catcher assembly includes a charge device 17 opposite the jets 18*a*, 18*b*, 18*c*, and 18*d* for providing a charge to the selected drops formed from the jet array. Drops selectively charged by the charge device are deflected so that the drops strike the catcher 23. The catcher 23 and, optionally, a catcher plate (not shown) are part of the catcher assembly 22. An eyelid 25 has a sealing engagement with the catcher assembly. A catcher return line 26 and an anti-wicking return line 34 are connected to the catcher 23. Either one or both of the catcher return line 26 and the anti-wicking return line 34 recycle fluid back to the reservoir.

To use the system, a flushing fluid pump 28 pumps flushing fluid 29 from a source of flushing fluid 31 through a flushing fluid valve 30 and a flushing fluid supply line 32 to the drop generator 14.

A controller, which includes a central processing unit, communicates with the valves and pumps to control the pressurization and the opening and closing of the valves.

Transducers, such as pressure transducers, can be located in the fluid lines and catcher assembly of the print station to provide sensor information on pressure and flow rates to the controller to regulate pressure and flow rates through the lines. Typical usable transducers are Kavlico transducers.

Figure 2:
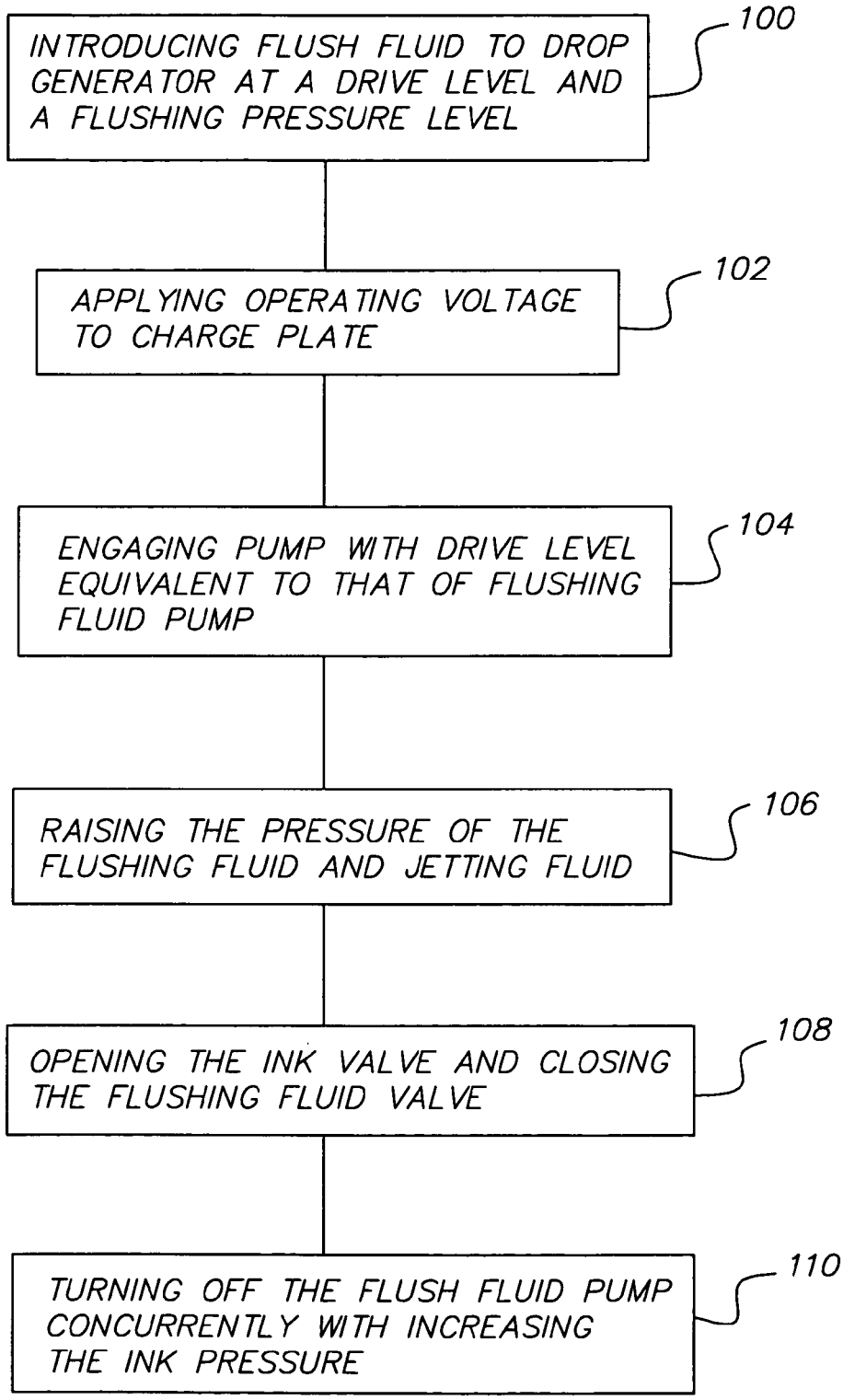
FIG. 2 depicts a block diagram of the automatic startup sequence.

FIG. 2 depicts a flow chart showing the steps of the method for automatic start up of the printhead. Using the equipment described in FIG. 1, a flushing fluid is pumped using the flushing fluid pump through the flushing fluid valve to the drop generator at a drive level and at a flushing pressure. The drive level and flushing pressure enables jetting of the flushing fluid through the orifice structure at a flow rate adequate so that flushing fluid supplied to the drop generator can be extracted by the catcher assembly (Step 100).

Next, a voltage is applied to the charge device 17 (Step 102). The charge device 17 can be a charge plate. The voltage is preferably the operating voltage of the charge device.

As the next step, the ink pump 35 is then engaged using a drive level equivalent to the drive level of the flushing fluid pump, and the ink supply line is pressurized (Step 104).

Once the ink pump raises the pressure of the ink, the pressure of the flushing fluid is increased while jetting the flushing fluid to a pressure between a first pressure for stable drop formation and drop deflection from the jet array, and a second pressure sufficiently low enough to extract drops from the catcher assembly and permit flushing fluid to flow freely through the catcher assembly into the catcher return line and the anti-wicking return line 34 (Step 106).

Simultaneously, the ink valve 40 is opened and the flushing fluid valve 30 is closed whereupon pressurized ink flows into the drop generator 14 (Step 108).

Finally, the flushing fluid is turned off while the pressure of the ink supply line increases (Step 110), forming stable ink jets with high image quality.

The method contemplates using a drive level that is a voltage level. The method can involve using a drive level that is a duty cycle level for pulse width modulation.

The method can include the step of stimulating the drop generator with a stimulating voltage prior to applying the operating voltage to the charge device. In a preferred embodiment, the stimulating voltage is up to three volts.

Figure 3:
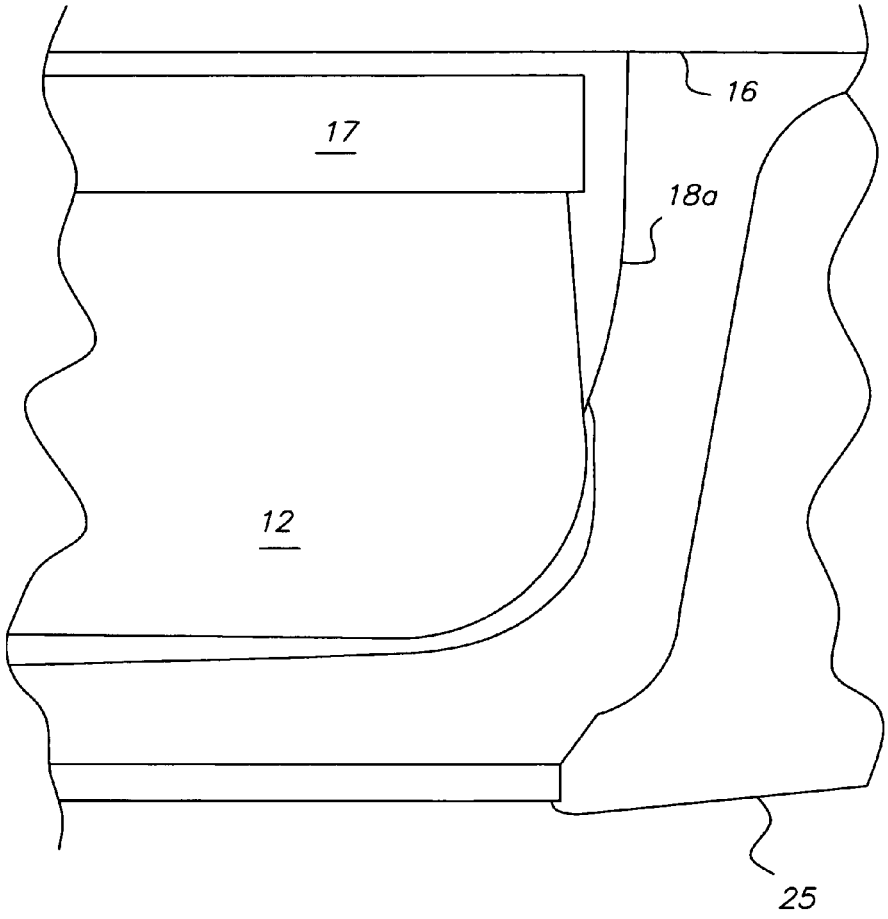
FIG. 3 depicts a detailed view of an eyelid sealed against a catcher assembly as used in an embodied method.

FIG. 3 is a detailed cross sectional view of a drop generator and a catcher 12 with an eyelid 25. The eyelid 25 is shown sealed against the catcher assembly.

The pressures can be monitored with transducers disposed in the fluid lines. A controller can be used to monitor pressures, open and close the various valves, provide the appropriate voltages to the charge places, and operate the other equipment of the printhead.

In this embodiment, the operating voltage of the charge device can range between 115 volts and 180 volts.

In this embodiment, the flushing fluid pump can have an operating pressure between 5 psi and 7.5 psi.

The embodiments have been described in detail with particular reference to certain preferred embodiments thereof, but it will be understood that variations and modifications can be effected within the scope of the embodiments, especially to those skilled in the art.

PARTS LIST

10. ink supply line
11. reservoir for ink
14. drop generator
16. orifice structure
17. charge device
18*a*. jet of jet array
18*b* jet of jet array
18*c* jet of jet array
18*d* jet of jet array
22. catcher assembly
23 catcher
25 eyelid
26. catcher return line
28. flushing fluid pump
29. flushing fluid
30. flushing fluid valve
31. source of flushing fluid
32. flushing fluid line
34. anti-wicking return line
36. an ink pump
40. ink supply valve
42. ink
100. step—introducing flushing fluid to the drop generator
102. step—applying an operating voltage to the charge device
104. step—engaging the ink pump with voltage of the flushing fluid pump
106. step—raising the pressure of the flushing fluid
108. step—opening an ink valve and closing a flush fluid valve
110. step—turning off the flushing fluid pump and concurrently increasing the pressure of the ink.

What is claimed is:

1. An automatic startup sequence for an ink jet print station using solvent based ink, wherein the print station comprises an ink supply line connected to a drop generator; an orifice structure connected to the drop generator forming a jet array; a catcher assembly disposed opposite the jet array comprising a charge device, an eyelid for engaging a catcher, a catcher return line, a flushing fluid line connected to the drop generator, a flushing fluid pump, and a flushing fluid valve disposed in the flushing fluid line; an anti-wicking return line; an ink pump; and ink supply valve disposed in the ink supply line, and wherein the method comprises the steps of:

a. introducing a flushing fluid to the drop generator using the flushing fluid pump at a drive level, wherein the flushing fluid is introduced at an initial flushing pressure that enables flushing fluid to flow through the jet array at a flow rate adequate to permit the catcher assembly to extract the flushing fluid;

b. applying an operating voltage to the charge device;

c. engaging the ink pump using a drive level equivalent to the drive level of the flushing fluid pump to pressurize the ink supply line;

d. increasing the pressure of the flushing fluid from the initial flushing pressure while passing the flushing fluid through the jet array to an increased pressure, wherein the increased pressure is between a first pressure for stable drop formation and drop deflection from the jet array, and a second pressure sufficiently low to extract drops from the catcher assembly and permitting flushing fluid to flow freely through the catcher assembly and the anti-wicking return line;

e. simultaneously, opening the ink supply valve and closing the flushing fluid valve permitting ink to flow into the drop generator; and f. stopping the flow of the flushing fluid concurrently while increasing the pressure of the ink supply line to a stored operating value.

2. The method of claim 1, wherein the operating voltage of the charge device ranges between 115 volts and 180 volts.

3. The method of claim 1, wherein the flushing pressure is between 5 psi and 7.5 psi.

4. The method of claim 1, wherein the drive level comprises a voltage level.

5. The method of claim 1, wherein the drive level comprises a duty cycle level for pulse width modulation.

6. The method of claim 1, further comprising the step of stimulating the drop generator with a stimulating voltage prior to applying operating voltage to the charge device.

7. The method of claim 6, wherein the stimulating voltage is up to three volts.

* * * * *